US006161313A

United States Patent [19]

Bisson

[11] Patent Number: 6,161,313

[45] Date of Patent: Dec. 19, 2000

[54] METATARSAL SAFETY GUARD FOR FOOTWEAR

[75] Inventor: Michel Bisson, Blainville, Canada

[73] Assignee: STC Footwear Inc., Canada

[21] Appl. No.: 09/237,242

[22] Filed: Jan. 26, 1999

[51] Int. Cl.[7] ..... A43B 13/22; A43C 13/14

[52] U.S. Cl. ..... 36/72 R; 36/77 R; 36/77 M

[58] Field of Search ..... 36/72 R, 77 R, 36/77 M

[56] References Cited

U.S. PATENT DOCUMENTS

| | | | |
|---|---|---|---|
| 1,872,025 | 8/1932 | Baynard et al. | 36/72 R |
| 2,615,261 | 10/1952 | La Grotto . | |
| 2,661,547 | 12/1953 | Hyde et al. | 36/72 R |
| 3,175,292 | 3/1965 | MacQuaid et al. . | |
| 3,175,310 | 3/1965 | MacQuaid | 36/72 R |
| 3,241,153 | 3/1966 | Brewer | 36/72 R |
| 3,841,004 | 10/1974 | Gray et al. . | |
| 4,908,963 | 3/1990 | Krajcir et al. | 36/77 R |
| 4,967,493 | 11/1990 | Mues | 36/72 R |
| 5,457,898 | 10/1995 | Fortin et al. | 36/72 R |
| 5,711,092 | 1/1998 | Despres et al. | 36/72 R |
| 5,878,511 | 3/1999 | Krajcir | 36/77 R |

FOREIGN PATENT DOCUMENTS 2119837 9/1998 Canada .

*Primary Examiner*—Paul T. Sewell
*Assistant Examiner*—Anthony Stashick
*Attorney, Agent, or Firm*—Diller, Ramik & Wight, PC

[57] ABSTRACT

A metatarsal guard for footwear comprises an arched body which covers a dorsal surface of a wearer's metatarsal foot area. The arched body has lateral bottom edges for engaging a footwear sole to transmit loads from the arched body to the footwear sole. Slits are defined in a rear portion of the arched body so as to form a longitudinally extending central T-shaped tongue and two longitudinally extending lateral tongues in order to increase the flexibility of the metatarsal guard. The T-shaped tongue has a rear edge extending in a concave curved line transversally of the footwear so as to prevent transmission of punctual loads to the wearer's foot. By optimizing the number and the configuration of the tongues, both the wearer's comfort and protection are maximized.

9 Claims, 3 Drawing Sheets

METATARSAL SAFETY GUARD FOR FOOTWEAR

BACKGROUND OF THE INVENTION

1. Field of the Invention

The present invention relates to footwear and, more particularly, pertains to foot protection against injury caused by compression and impact loads.

2. Description of the Prior Art

Safety footwear is well known in the prior art. Typically, safety footwear, such as safety boots or shoes, includes a toe cap and a metatarsal guard. These guards are made of various high impact-resistant materials to protect a wearer's foot from injuries resulting, for instance, from the impact of falling heavy objects.

Over the years, various attempts have been made to render these guards more comfortable while still providing adequate protection to a wearer's feet.

For example, Canadian Patent No. 2,119,837 issued on Sep. 22, 1998 to Fortin et al. discloses a plastic metatarsal guard having a rear portion in which slits are defined so as to form a transversal series of longitudinally extending tongues that spread apart to follow the movement of the foot when walking. The central tongue is provided at a distal end thereof with an integral flap which is folded against the top surface of the tongues in order to distribute the load on the different tongues upon impact of a falling object.

Although the metatarsal guard described in the above mentioned patent is effective, it can be appreciated that the folding of the flap over the tongues requires an additional manufacturing step and also reduces the flexibility of the guard. Furthermore, it has been found that there is a need for a metatarsal guard which allows a user to comfortably assume a crouched position without the discomfort of having the rear edge of the guard unevenly coming in contact against the dorsal portion of the instep.

SUMMARY OF THE INVENTION

It is therefore an aim of the present invention to provide an improved metatarsal safety guard which provides adequate protection while being comfortable to wear.

It is a further aim of the present invention to provide such a metatarsal safety guard which is relatively simple and economical to manufacture.

Therefore, in accordance with the present invention there is provided a metatarsal safety guard for footwear having a longitudinal axis, comprising an arched body adapted to cover a dorsal surface of a wearer's metatarsal foot area. The arched body has a rear edge overlying a tarsus area of a wearer's foot. The rear edge has at least a central portion extending in a concave curved line transversally of the footwear so as to prevent punctual load transmission to the wearer's foot upon impact of an object against the metatarsal safety guard.

Also in accordance with the present invention, there is provided a metatarsal safety guard for footwear, comprising an arched body adapted to cover an upper surface of a wearer's metatarsal foot area and having lateral bottom edges adapted to engage a footwear sole to transmit loads from the arched body to the footwear sole. Slit means are defined in a rear portion of the arched body so as to form a longitudinally extending central T-shaped tongue having an axially extending shank portion and a transversal portion. The slit means further form up to two longitudinally extending lateral main tongues adjacent the central T-shaped tongue on opposed sides thereof. The main tongues extend along the shank portion of the central T-shaped tongue and at least partly of the transversal portion thereof.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
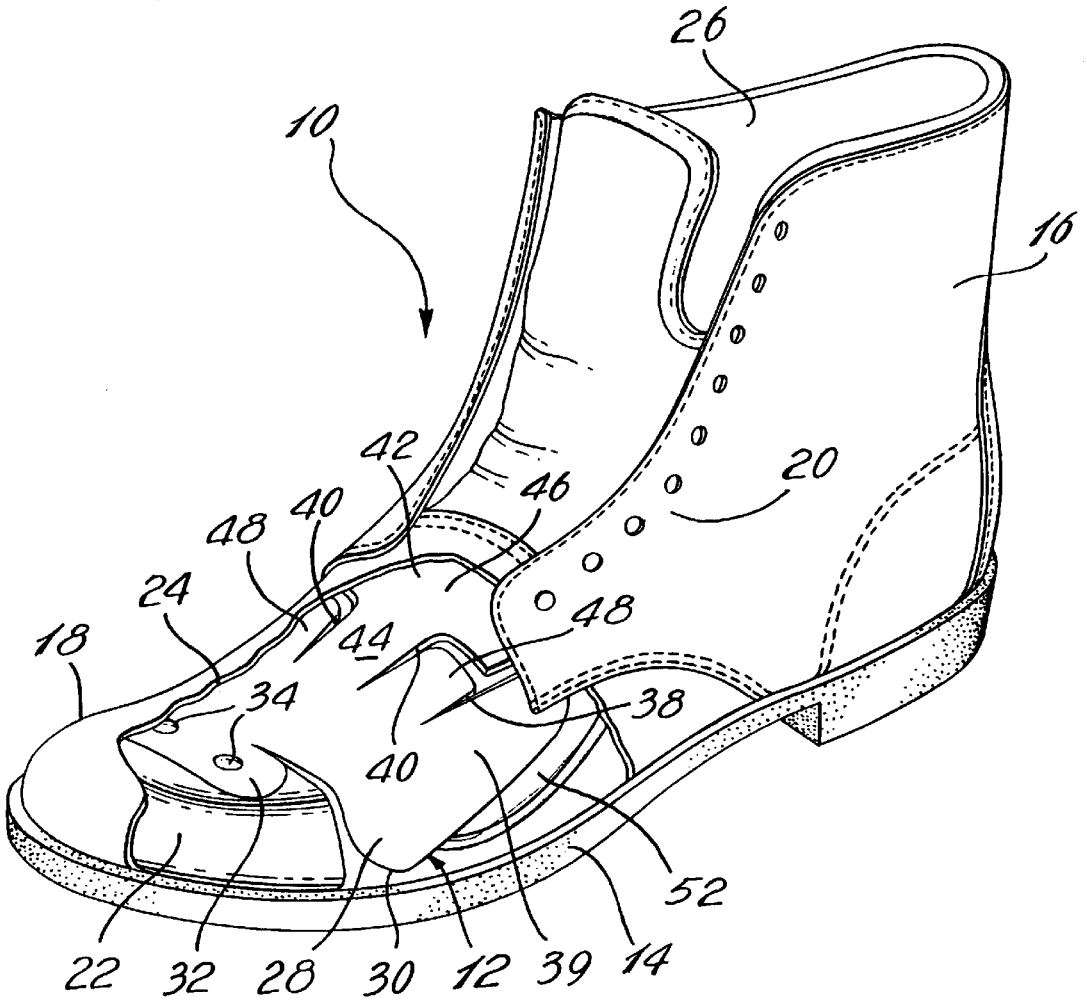
FIG. 1 is a perspective view partly in cross-section of a left safety boot incorporating a metatarsal guard in accordance with the present invention.

Referring now more specifically to FIG. 1, a safety boot 10 incorporating a metatarsal safety guard 12 in accordance with an embodiment of the present invention, includes a sole 14 and an upper 16 mounted to the periphery of the sole 14. The upper 16 includes a toe portion 18 and an instep portion 20.

A rigid toe cap 22 is secured within the toe portion 18 of the upper 16 between an outer layer 24 and an inner liner 26 of the boot 10 for protecting the toe area of a wearer's foot against injuries resulting from the impact of a moving, falling or rolling object with the toe portion 18 of the safety boot 10, as is well known in the art. The toe portion 18 may be made of steel or other suitable high impact-resistant material.

The metatarsal safety guard 12 is preferably formed of a sheet 28 of suitable high impact-resistant plastic material which offers lightness in weight. According to one embodiment, the metatarsal safety guard 12 is obtained by first cutting the sheet 28 and then thermoforming the same on a template. Alternatively, the metatarsal safety guard 12 could be formed by injection.

The metatarsal safety guard 12 has an arched configuration to generally conform to the dorsal surface of the metatarsal area of a wearer's foot. The metatarsal safety guard 12 is provided on each side thereof with a substantially planar bottom bearing edge 30 for contacting the inner surface of the sole 14 upon an impact of an object with the metatarsal safety guard 12, thereby ensuring proper distribution of the compressive loads.

Figure 2:
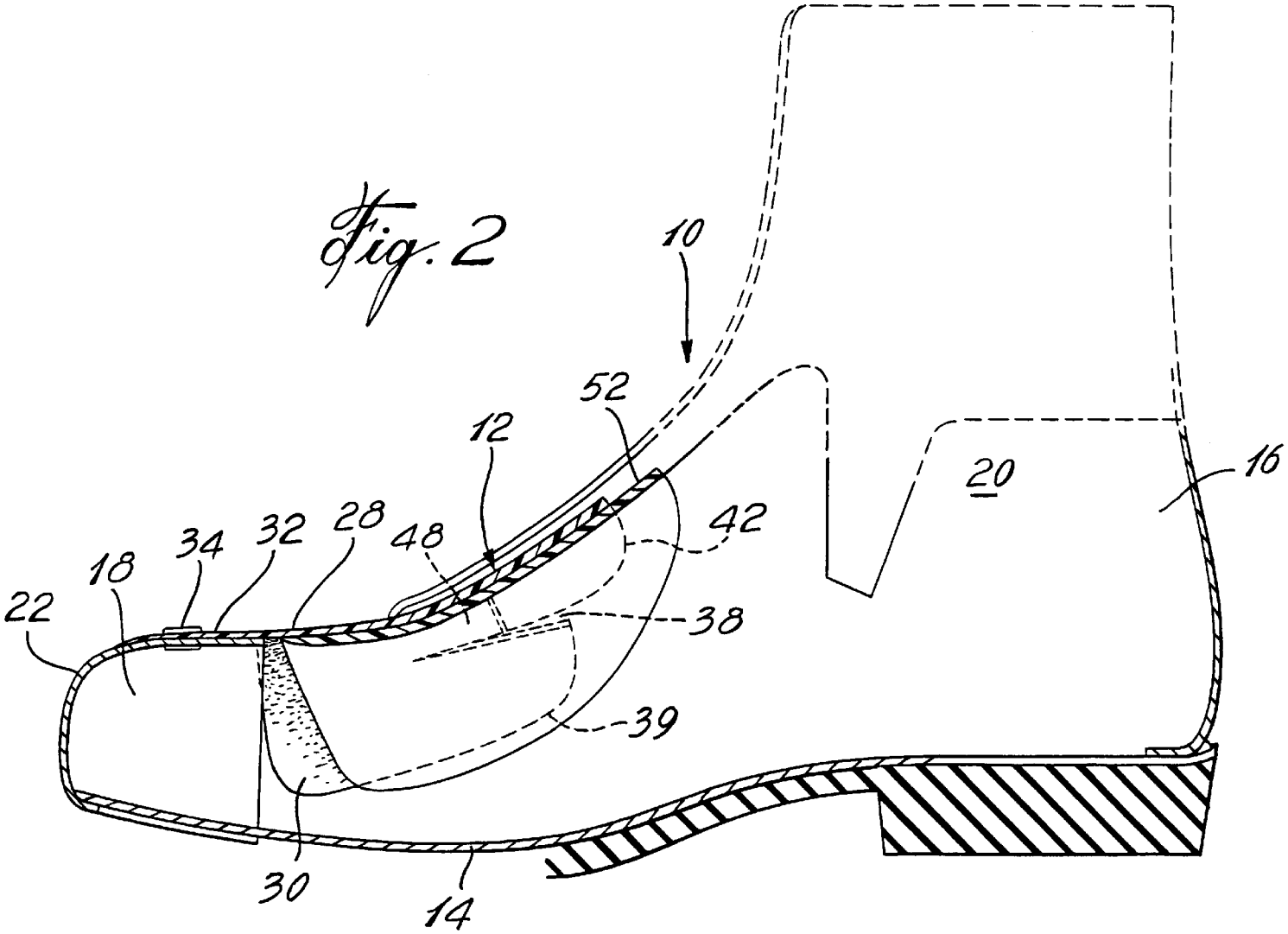
FIG. 2 is a side view partly in cross-section of the safety boot and metatarsal guard of FIG. 1.

According to the embodiment illustrated in FIGS. 1 and 2, the metatarsal safety guard 12 is provided with a forward extension 32 which is connected to the top surface of the toe cap 22 by means of a pair of rivets 34.

Figure 3:
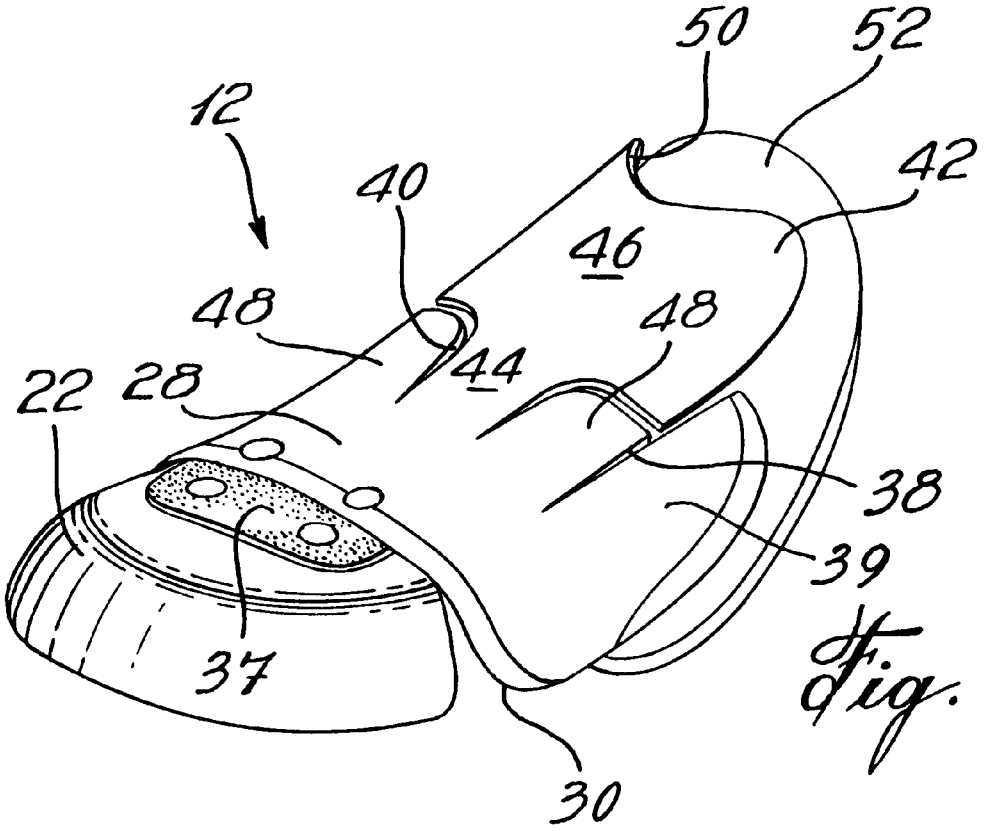
FIG. 3 is a perspective view of the metatarsal guard illustrating another possible attachment of the metatarsal guard to a toe cap.

Referring to FIG. 3, it can be seen that the metatarsal guard 12 can be connected to the toe cap 12 through a band 37 riveted at a front end thereof to the top surface of the toe cap 22 and at a rear end thereof to an undersurface of the metatarsal guard 12. The band 37 may be made of a layer of a PVC or polyethylene material disposed between two layers of fabric material, such as Nylon yarn. This composite structure of the band 37 will enable the metatarsal guard 12 to pivot with respect to the toe cap 22, while preventing the guard 12 to be displaced towards the front end of the safety boot 10.

Because the metatarsal guard 12 is connected to the toe cap 22, the compressive forces caused by the impact of a falling heavy object on the metatarsal guard 12 will also be distributed to the toe cap 22.

A pair of longitudinally extending slits 38 are defined in the rear end portion of the metatarsal guard 12 for easy flexure of the same, thereby allowing a user to walk normally and kneel without interference from the metatarsal guard 12. According to the illustrated embodiment, the longitudinally extending slits 38 are substantially symmetrically disposed relative to a median longitudinal axis of the metatarsal guard 12 and form two longitudinally extending lateral main tongues 39. However, it is understood that the slits 38 could be asymmetrically disposed with respect to the median longitudinal axis of the metatarsal guard 12. Moreover, it is noted that the longitudinal and transversal dimensions of the left and right lateral tongues 39 can be different.

A curved slit 40 extends inwardly from each slit 38 towards the front end of the metatarsal guard 12. The curved slits 40 along with the longitudinal slits 38 form a rearwardly extending central flexible T-shaped tongue 42.

The T-shaped tongue 42 includes an axially extending shank portion 44 and a transversal portion 46. As seen in FIGS. 1 to 3, the lateral main tongues 39 extend in the longitudinal direction of the metatarsal guard 12 along the shank portion 44 and at least partly of the transversal portion 46 of the T-shaped tongue 42.

The longitudinally extending slits 38 and the curved slits 40 further form two longitudinally extending secondary tongues 48 on opposed sides of the shank portion 44 of the T-shaped tongue 42 below the transversal portion 46 thereof.

The proximal end or root of the T-shaped tongue 42, the lateral main tongues 39 and the secondary tongues 48 are spaced from the forward end of the safety shoe 10 by at least 3 inches to ensure that the main metatarsal area of the shoe 10 be covered by the more rigid part of the metatarsal guard 12 that is the part of the guard 12 located in front of the proximal ends of the T-shaped tongues 42, the lateral main tongues 39 and the secondary tongues 48.

Because the slits 38 and 40 are narrow and their number kept to a minimum, the surface covered by the metatarsal guard 12 is increased, thereby affording better protection to the user. Furthermore, by minimizing the number of slits and the dimensions thereof, the area covered by each tongue, formed in the metatarsal guard 12 is increased and, thus, a more uniform distribution of the impact load is achieved. Thus, the manufacturing cost of the metatarsal guard 12 is kept to a minimum while simultaneously providing flexibility and consequently the comfort of the wearer. In summary, it can be said, that the above described slit configuration allows the reduction of the number of tongues required to provide flexure of the metatarsal guard 12 when walking, while simultaneously maximizing the area of the tongues to ensure efficient distribution of the load applied to the metatarsal guard 12.

As seen in FIGS. 1 and 3, the transversal portion of the T-shaped tongue 42 is provided with a concave rear edge 50 to ensure that the wearer can comfortably assume a crouched position without the discomfort of the dorsal part of the insteps unevenly coming up against the rear edge of the metatarsal guard 12. Indeed, the concavity of the rear edge 50 of the T-shaped tongue 42 is generally conformed to the curvature of the wearer's instep in order to increase the contact surfaces therebetween. Accordingly, in the event that a heavy object is dropped on the guard, the portion of the load transmitted to the wearer's foot will be more uniformly distributed, thereby improving the protection of the wearer.

A resilient pad 52 of foam material is secured on the inner side of the metatarsal guard 12 at the rear portion thereof for absorbing the shock caused by an impact on the metatarsal guard 12.

As seen in FIG. 1, the metatarsal guard 12 and the resilient pad 52 are disposed into the upper 16 of the safety boot 10 between the outer layer 24 and the inner liner 26.

Finally, although the present invention has been described in connection with a left safety boot 10, it is understood that the right metatarsal guard is identical but symmetrical to the above described left metatarsal guard 12.

What is claimed is:

1. An internal metatarsal safety guard for use within a footwear article having a longitudinal axis, said metatarsal safety guard comprising a flexible arched body adapted to cover a dorsal surface of a wearer's metatarsal foot area, said arch body having a rear edge overlying a tarsus area of a wearer's foot, said rear edge having at least a central load transmission portion extending in a concave curved line transversally of the footwear article so as to prevent punctual load transmission to the wearer's foot upon flexural deformation of said arched body due to an impact of an object against said metatarsal safety guard, wherein said load transmission portion is provided at a distal rear edge of a transversal portion of a longitudinally extending central T-shaped tongue formed in said arched body, said transversal portion of said T-shaped tongue being disposed rearwardly of a shank portion thereof, wherein at least two slits are defined in a rear portion of said arched body so as to form said longitudinally extending central T-shaped tongue and two longitudinally extending lateral tongues adjacent said central T-shaped tongue on opposed sides and wherein said central T-shaped tongue includes an axially extending shank portion and a transversal portion, and wherein said at least two slits further form a pair of secondary longitudinally extending tongues on opposed sides of said axially extending shank portion between said longitudinally extending lateral tongues.

2. An internal metatarsal safety guard as defined in claim 1, wherein said at least two slits include a pair of longitudinally extending slits disposed on opposed sides of a longitudinal median axis of said metatarsal safety guard, and a pair of curved slits extending inwardly from respective ones of said longitudinally extending slits towards a front end of said metatarsal safety guard.

3. An internal metatarsal safety guard as defined in claim 1, wherein said arched body is made of a unitary piece of resilient plastic material.

4. An internal metatarsal safety guard as defined in claim 1, wherein said arched body is provided with lateral bottom edges adapted to engage a footwear sole to transmit loads applied against said arched body to the footwear sole.

5. An internal metatarsal safety guard in combination with a footwear article, comprising an arched body adapted to cover an upper surface of a wearer's metatarsal foot area and having lateral bottom edges adapted to engage a footwear sole to transmit loads from the arched body to the footwear sole, at least two slits defined in a rear portion of said arched body so as to form a longitudinally extending central T-shaped tongue having an axially extending shank portion and a transversal portion, said transversal portion being disposed rearwardly of said shank portion, said at least two slits further forming up to two longitudinally extending lateral main tongues adjacent said central T-shaped tongue on opposed sides thereof, said main tongues extending along said shank portion of said central T-shaped tongue and at least partly of said transversal portion thereof, wherein said central T-shaped tongue has a rear edge extending in a concave curved line transversally of said metatarsal safety guard, and wherein said at least two slits include a first pair of longitudinally extending slits disposed on opposed sides of a longitudinal median axis of said metatarsal safety guard, and a second pair of slits extending inwardly from respective ones of said longitudinally extending slits towards a front end of said metatarsal safety guard, each said slit of said second pair having a first segment extending in a transversal direction relative to said longitudinal median axis and a second segment extending in a longitudinal direction of said arched body so as to form said axially extending shank portion of said central T-shaped tongue.

6. A combination as defined in claim 5, wherein said first and second pairs of slits further form a pair of secondary longitudinally extending tongues on opposed sides of said axially extending shank portion between said longitudinally extending lateral main tongues.

7. A combination as defined in claim 5, wherein said arched body is made of a unitary piece of relatively stiff, resilient plastic material.

8. A combination as defined in claim 5, wherein said central T-shaped tongue, said longitudinally extending lateral main tongues and said secondary tongues include respective proximal ends, said respective proximal ends being disposed at a distance of at least 3 inches from a forward end of the footwear article.

9. A combination as defined in claim 7, further comprising a flexible band secured at a first end thereof to said arched body and at a second end thereof to a toe cap, said band being made of a layer of plastic material disposed between two layers of fabric material.

* * * * *